US006980181B2

(12) United States Patent
Sudo

(10) Patent No.: US 6,980,181 B2
(45) Date of Patent: Dec. 27, 2005

(54) LED DRIVE CIRCUIT

(75) Inventor: Minoru Sudo, Chiba (JP)

(73) Assignee: Seiko Instruments Inc., Chiba (JP)

( * ) Notice: Subject to any disclaimer, the term of this patent is extended or adjusted under 35 U.S.C. 154(b) by 176 days.

(21) Appl. No.: 10/068,384

(22) Filed: Feb. 7, 2002

(65) Prior Publication Data

US 2002/0105373 A1 Aug. 8, 2002

(30) Foreign Application Priority Data

Feb. 8, 2001 (JP) ..... 2001-032261
Jan. 29, 2002 (JP) ..... 2002-020623

(51) Int. Cl.[7] ..... G09G 3/32
(52) U.S. Cl. ..... 345/82; 345/102; 345/46
(58) Field of Search ..... 345/82, 83, 102, 345/55, 39, 44, 46

(56) References Cited

U.S. PATENT DOCUMENTS 4,967,192 A * 10/1990 Hirane et al. ..... 345/211
5,061,861 A * 10/1991 Sameshima et al. ..... 327/109
6,400,349 B1 * 6/2002 Nagumo ..... 345/82
6,466,188 B1 * 10/2002 Cato ..... 345/82
6,486,726 B1 * 11/2002 Worley et al. ..... 327/514
6,628,252 B2 * 9/2003 Hoshino et al. ..... 345/82

* cited by examiner

*Primary Examiner*—Jimmy H. Nguyen
(74) *Attorney, Agent, or Firm*—Adams & Wilks

(57) ABSTRACT

An LED drive circuit having reduced power consumption has a constant current generating circuit for driving a plurality of LEDs and at least one switch connected to a respective LED for periodically turning on and off the respective LED at a rate higher than a visual perception rate to reduce power consumption.

6 Claims, 8 Drawing Sheets

LED DRIVE CIRCUIT

BACKGROUND OF THE INVENTION

1. Field of the Invention

The present invention relates to an LED drive circuit which causes a light emitting diode (LED) to blink periodically to reduce power consumed by the LED.

2. Description of the Related Art

A conventional LED drive circuit such as shown in the circuit diagram of FIG. 15 is known. That is, a power supply of a voltage VDD [V] is connected to a power supply terminal 10, and a constant current generation circuit 15 operates in such a manner that a voltage difference between an output voltage Vref [V] of a reference voltage circuit 11 and a voltage Va [V] across a resistor 13 is amplified by an error amplifier 12 to control a gate voltage Verr for a transistor 14 so that Vref−Va=0.

In this drive circuit, LEDs 19 and 20 are respectively connected to two output terminals 1 and 2.

If the resistance value of the resistor 13 is R13 [Ω], a current I=Va/R13 [A] flows through the resistor R13. The same current as that flowing through the resistor R13 also flows through transistors 14 and 16. If all of transistors 16 to 18 are identical in characteristics, a current mirror circuit 21 causes the same current as that flowing through the transistor 16 to flow through each of the transistors 17 and 18, thereby lighting the LEDs 19 and 20.

That is, currents Iout1 and Iout2 flowing through the LEDs 19 and 20 are given by the following equation (1):

$$I\text{out}\mathbf{1}=I\text{out}\mathbf{2}=Va/R\mathbf{13}[A] \quad (1)$$

Therefore the currents caused to flow through the LEDs 19 and 20 can be set to a desired current value by adjusting the value of the resistor 13 or the output voltage value of the reference voltage circuit 11.

If power consumed by the reference voltage circuit 11 and the error amplifier circuit 12 is negligibly small in comparison with power consumed by the LEDS, power Pd consumed by the LED drive circuit shown in FIG. 15 is given by the following equation (2):

$$Pd=VDD\times Va/R\mathbf{13}\times 3[A] \quad (2)$$

To reduce power consumption in the conventional LED drive circuit, however, it is necessary to reduce the LED current. If the LED current is reduced, a problem of reduction in luminance of the LED arises.

SUMMARY OF THE INVENTION

In view of the problem of the conventional art, an object of the present invention is to provide an LED drive circuit designed to reduce power consumption while maintaining the same luminance of LEDs observed with the eye as that obtained by the conventional LED drive circuit.

To achieve the above-described object, the present invention provides an LED drive circuit arranged to light LEDs in a time-division manner different from a continuous-lighting manner to reduce power consumption in the LED drive circuit.

DETAILED DESCRIPTION OF THE PREFERRED EMBODIMENTS (Embodiment 1)

Figure 1:
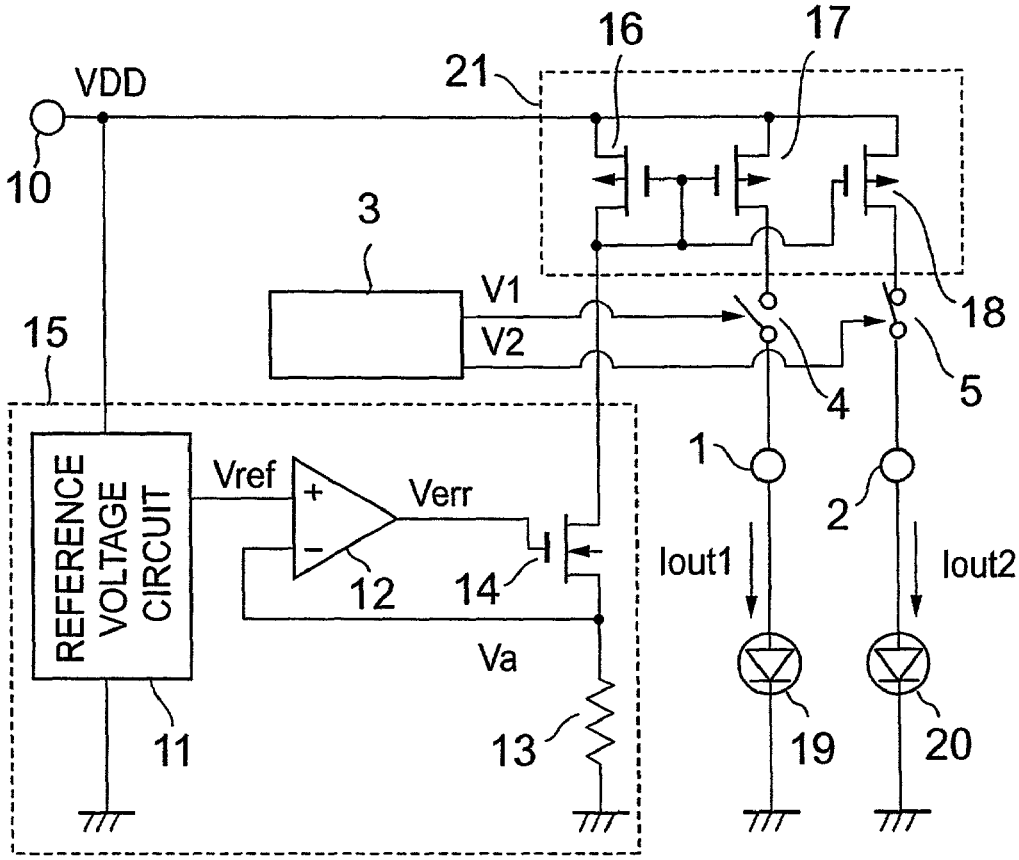
FIG. 1 is a diagram showing an LED drive circuit which represents Embodiment 1 of the present invention.

Embodiments of the present invention will be described with reference to the accompanying drawings. FIG. 1 shows an LED drive circuit which represents Embodiment 1 of the present invention. A constant current generation circuit 15, a current mirror circuit 21, and LEDs 19 and 20 shown in FIG. 1 are the same as those in the conventional arrangement.

Switches 4 and 5 are respectively inserted between transistors 17 and 18 in the current mirror circuit and terminals 1 and 2 to which the LEDs are connected. ON/OFF control of the switches 4 and 5 is performed by means of signal voltages V1 and V2 from a switch control circuit 3.

Figure 2:
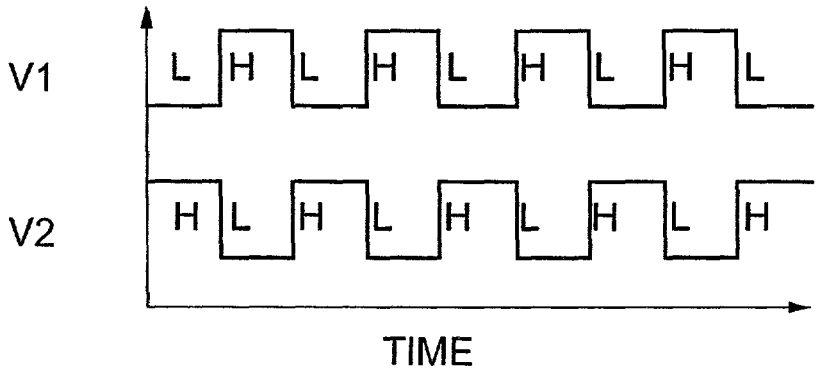
FIG. 2 is a diagram showing switch drive voltages in Embodiment 1 of the present invention.

FIG. 2 shows an example of signal voltages V1 and V2 from the switch control circuit 3. The abscissa represents time and the ordinate comprises two components respectively representing voltages V1 and V2. In the example shown in FIG. 2, voltages V1 and V2 change in a complementary relationship with each other. When V1 is high level (hereinafter referred to as H), V2 is low level (hereinafter referred to as L). If the switches 4 and 5 are turned on when both V1 and V2 are H, the LEDs 19 and 20 repeat blinking by being alternately lighted.

If power consumed by the reference voltage circuit 11 and the error amplifier circuit 12 and power consumed by the switch control circuit 3 during this operation are negligibly small in comparison with power consumed by the LEDs, power Pd consumed by the LED drive circuit shown in FIG. 1 is given by the following equation (3):

$$Pd=VDD\times Va/R\mathbf{13}\times(1+2\times 1/2)[W] \quad (3)$$

The total of time periods during which a current is fed through each LED is ½ of that in the conventional arrangement, so that power consumption in this embodiment can be limited to ⅔ of that in the conventional arrangement (power consumption in the LED section only is ½ of that in the conventional arrangement).

For example, in a case where LEDS are used as a backlight for a liquid crystal panel, the LEDs can be used by being lighted in the same time-division manner as in this embodiment instead of being continuously lighted in the conventional manner, thereby reducing power consumption while ensuring substantially the same display performance as that based on the conventional art thanks to persistence of vision.

While the LEDs 19 and 20 are alternately lighted in a blinking manner in the method shown in FIG. 2, a period during which both the LEDs 19 and 20 are lighted or a period during which neither of the LEDs 19 and 20 is lighted may be set. If only a period during which the LED 19 or 20 is not lighted is set, power consumption can be reduced by a corresponding amount from that in the case of conventional continuous lighting.

In a case where LEDs are lighted as a backlight for a liquid crystal panel, it is necessary to light the LEDs for time-division lighting in such a cycle that visual perceptibility of flicker is sufficiently low. That is, it is necessary that the frequency at which each LED is turning in time-division lighting be set to 5 Hz or higher.

Figure 3:
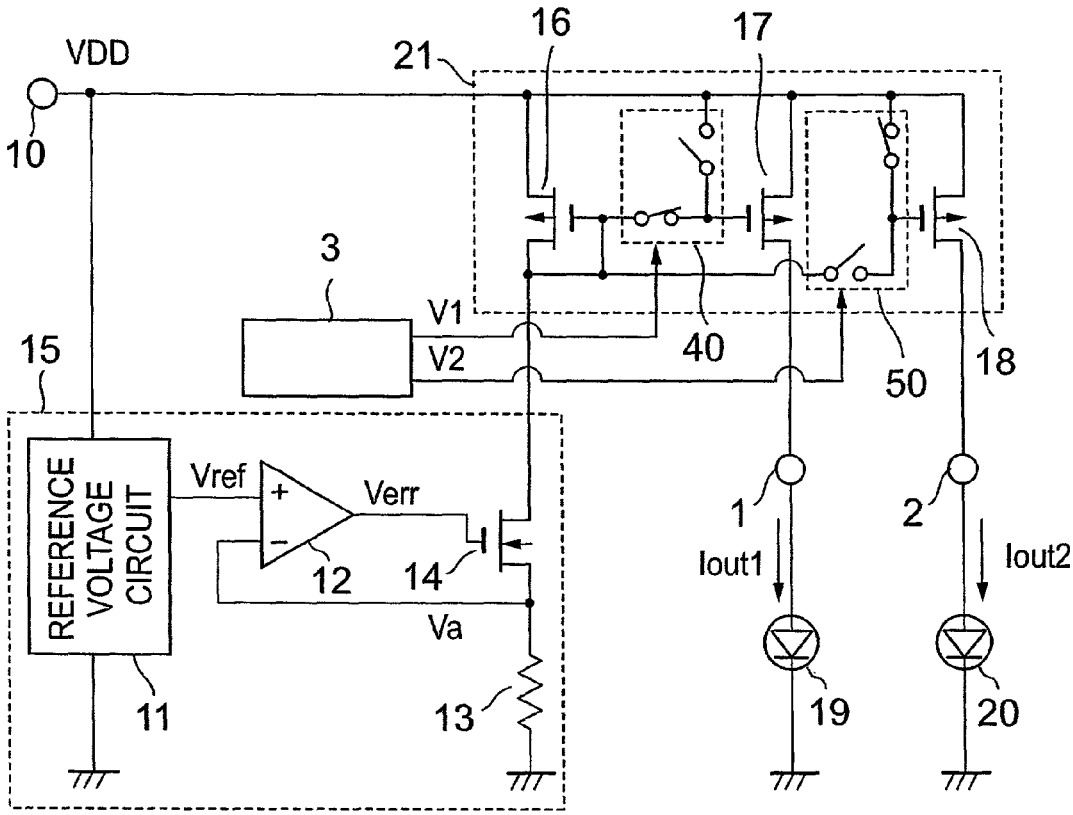
FIG. 3 is a diagram showing another LED drive circuit in Embodiment 1 of the present invention.

While in the circuit shown in FIG. 1, the switches 4 and 5 are inserted in the output lines from the transistors 17 and 18, the same effect can also be achieved in such a manner that, as shown in FIG. 3, the voltages applied to the gates of the transistors 17 and 18 are changed by switch circuits 40 and 50 on the basis of the signals from the switch control circuit 3. That is, when the signal V1 from the switch circuit 3 is H, the gate of the transistor 17 is connected to the gate of the transistor 16 to cause a current to flow through the LED 19. When the signal V1 is L, the gate of the transistor 17 is connected to VDD to shut off the current to the LED 19. Also, when the signal V2 from the switch circuit 3 is H, the gate of the transistor 18 is connected to the gate of the transistor 16 to cause a current to flow through the LED 20. When the signal V2 is L, the gate of the transistor 18 is connected to VDD to shut off the current to the LED 20.

A white-light LED may be used as a backlight for a liquid crystal panel. It is necessary to cause a current of 5 to 30 mA to flow through the LED, the current being selected by considering the light emitting efficiency of the LED. If the LEDs are lighted in time-division manner, it is possible to instantaneously feed a current larger than the rated current used in ordinary continuous energization. Thus, the effect of increasing the luminance can also be achieved.

(Embodiment 2)

Figure 4:
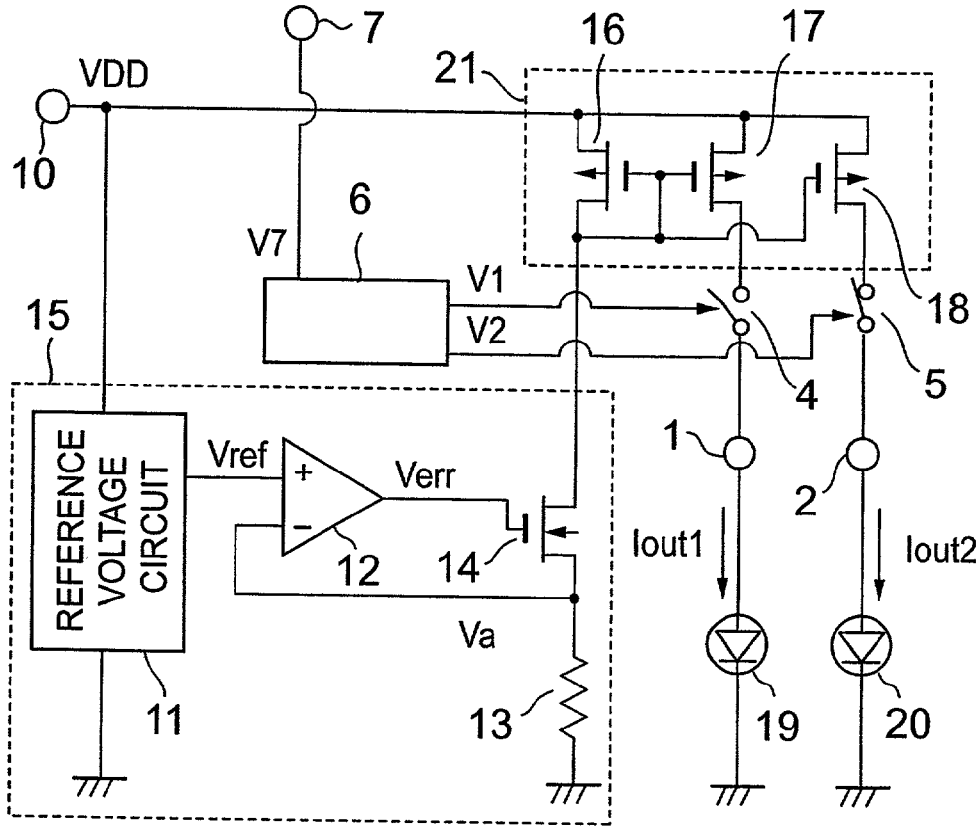
FIG. 4 is a diagram showing an LED drive circuit which represents Embodiment 2 of the present invention.

FIG. 4 shows an LED drive circuit which represents Embodiment 2 of the present invention. The same constant current generation circuit 15, current mirror circuit 21, and LEDs 19 and 20 as those in the conventional arrangement are used. Switches 4 and 5 are respectively inserted between transistors 17 and 18 in the current mirror circuit and terminals 1 and 2 to which the LEDs are connected. ON/OFF control of the switches 4 and 5 is performed by means of signal voltages V1 and V2 from a switch control circuit 6. A control terminal 7 to which a signal is externally supplied is connected to the switch control circuit 6. The cycle in which V1 and V2 change or the lighting time is controlled on the basis of signal V7 supplied through the control terminal 7.

Figure 5A:
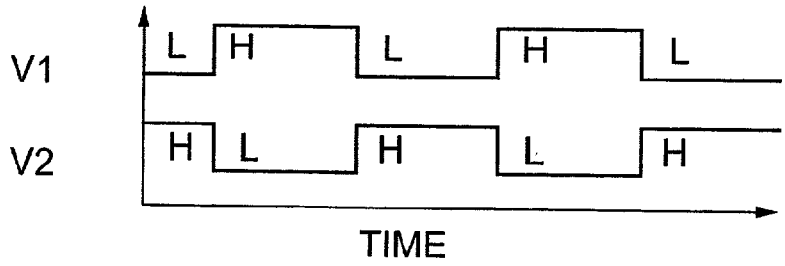
FIGS. 5A and 5B are diagrams showing an example of switch drive voltages in Embodiment 2 of the present invention.
Figure 5B:
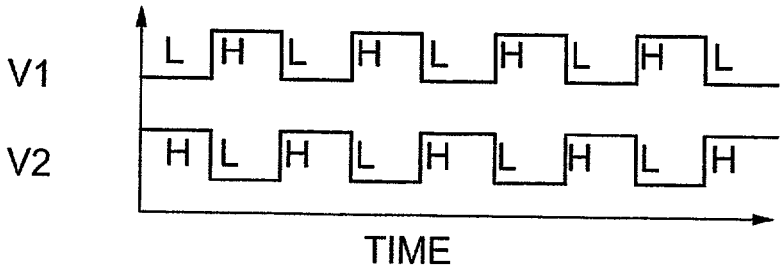

FIGS. 5A and 5B show an example of a change in cycle. FIG. 5A shows a case where the voltage V7 on the control terminal 7 is low, and FIG. 5B shows a case where the voltage V7 on the control terminal 7 is high. The frequency of an internal oscillation circuit of the switch control circuit 6 is changed through the voltage V7 on the control terminal 7. When the voltage V7 on the control terminal 7 is reduced, the frequency of the internal oscillation circuit of the switch control circuit 6 is lowered and the LED blinking cycle is increased. Conversely, when the voltage V7 on the control terminal 7 is increased, the LED blinking cycle is reduced.

In Embodiment 2, the cycle of blinking of the LEDs can be adjusted according to the size and a characteristic of a liquid crystal panel.

Figure 6A:
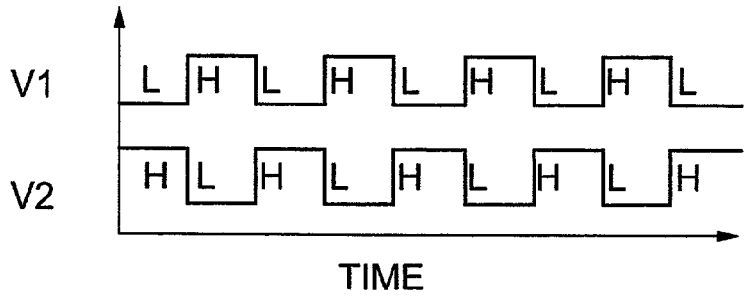
FIGS. 6A and 6B are diagrams showing another example of switch drive voltages in Embodiment 2 of the present invention.
Figure 6B:
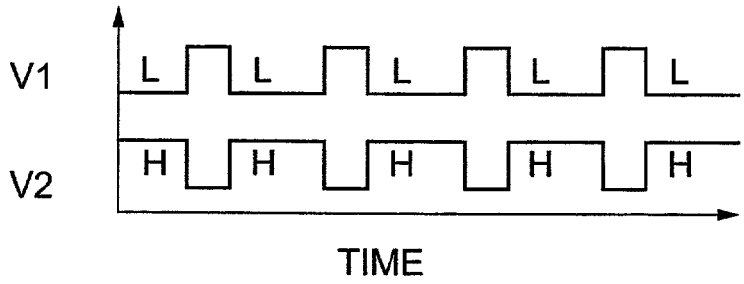

FIGS. 6A and 6B show an example of control of the LED on/off time on the basis of the signal supplied to the control terminal 7 in the arrangement shown in FIG. 4. FIG. 6A shows a case where the voltage V7 on the control terminal 7 is low, and FIG. 6B shows a case where the voltage V7 on the control terminal 7 is high. The time of a monostable multivibrator in the switch control circuit 6 is controlled in such a manner that when the voltage V7 on the control terminal 7 is low, the ratio of the on times for the LEDs 19 and 20 is an even ratio, 50:50, and, when the voltage V7 on the control terminal 7 is high, the LED 19 on time is reduced while the LED 20 on time is increased.

While the LEDS 19 and 20 are lighted in a complementary relationship with each other in the method shown in FIGS. 6A and 6B, a period during which both the LEDs 19 and 20 are lighted or a period during which neither of the LEDS 19 and 20 is lighted may be set.

Figure 7:
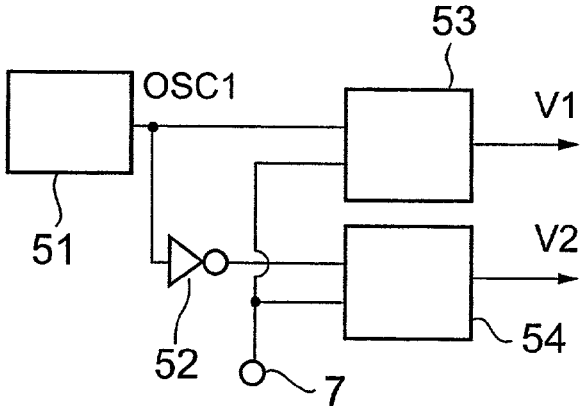
FIG. 7 is a diagram showing an example of a switch control circuit in Embodiment 2 of the present invention.

FIG. 7 shows an example of the control circuit 6 shown in FIG. 4 in a case where the LEDs 19 and 20 are caused to blink in a certain cycle. An oscillation circuit 51 oscillates in a certain cycle. An output OSC1 of the oscillation circuit is connected to a second monostable multivibrator 54 through a first monostable multivibrator 53 and an inverter 52. The monostable multivibrator 53 is triggered by a rise of the voltage of the OSC1 to output as voltage V1 a pulse with a duration determined by the voltage on the control terminal 7, while the monostable multivibrator 54 is triggered by a rise of the voltage of the inverter 52 to output as voltage V2 a pulse with a duration determined by the voltage on the control terminal 7.

Figure 8A:
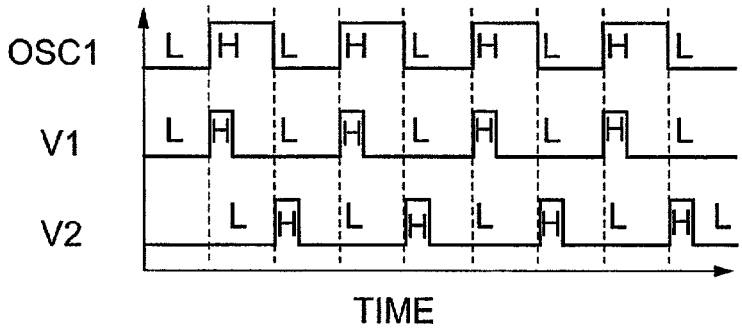
FIGS. 8A and 8B are diagrams showing another example of switch drive voltages in Embodiment 2 of the present invention.
Figure 8B:
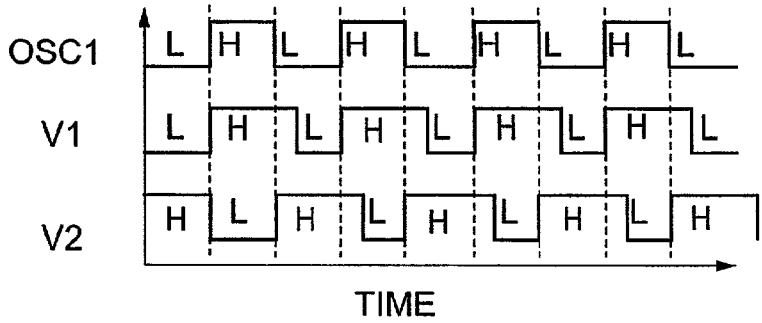

FIGS. 8A and 8B show an example of changes in outputs V1 and V2 from the monostable multivibrators 53 and 54 caused through selection of the voltage on the control terminal 7.

FIG. 8A shows voltages V1 and V2 when the voltage V7 on the control terminal 7 is low, and FIG. 8B shows voltages V1 and V2 when the voltage V7 on the control terminal 7 is high. FIGS. 8A and 8B show a case where the width of the pulse generated by each monostable multivibrator is small when the voltage V7 on the control terminal 7 is low, and is long when the voltage V7 on the control terminal 7 is high.

In Embodiment 2, the on/off time ratio and cycle of blinking of the LEDs can be adjusted according to the size of a liquid crystal panel, the temperature, and a characteristic such as display speed of the liquid crystal panel.

(Embodiment 3)

Figure 9A:
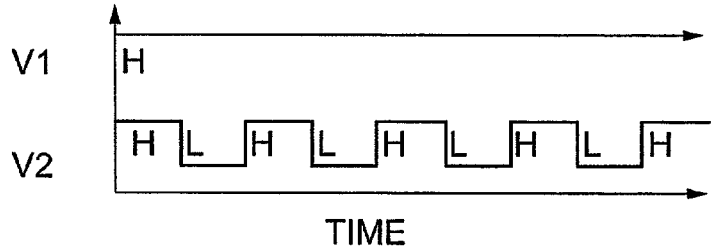
FIGS. 9A and 9B are diagrams showing an example of switch drive voltages in Embodiment 3 of the present invention.
Figure 9B:
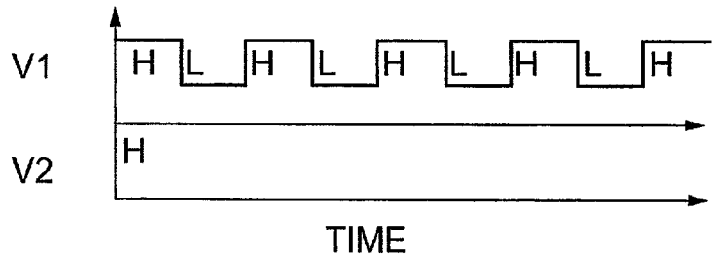

FIGS. 9A and 9B show Embodiment 3 of the present invention in which an LED is selected as an object of blinking control through a signal supplied to the control terminal 7 in the circuit shown in FIG. 3.

FIG. 9A shows voltages V1 and V2 when the voltage V7 on the control terminal 7 is low, and FIG. 9B shows voltages V1 and V2 when the voltage V7 on the control terminal 7 is high. When the voltage V7 on the control terminal 7 is low, the LED 19 is continuously lighted by maintaining V1 at H and control of blinking of the LED 20 is performed. On the other hand, when the voltage V7 on the control terminal 7 is high, the LED 20 is continuously lighted by maintaining V2 at H and control of blinking of the LED 19 is performed.

In Embodiment 3, one of a plurality of LEDs is continuously lighted while at least one of the other LEDs is controlled so as to blink, thus enabling LED drive for a backlight under a requirement of low power consumption according to use of a liquid crystal panel.

(Embodiment 4)

Figure 10:
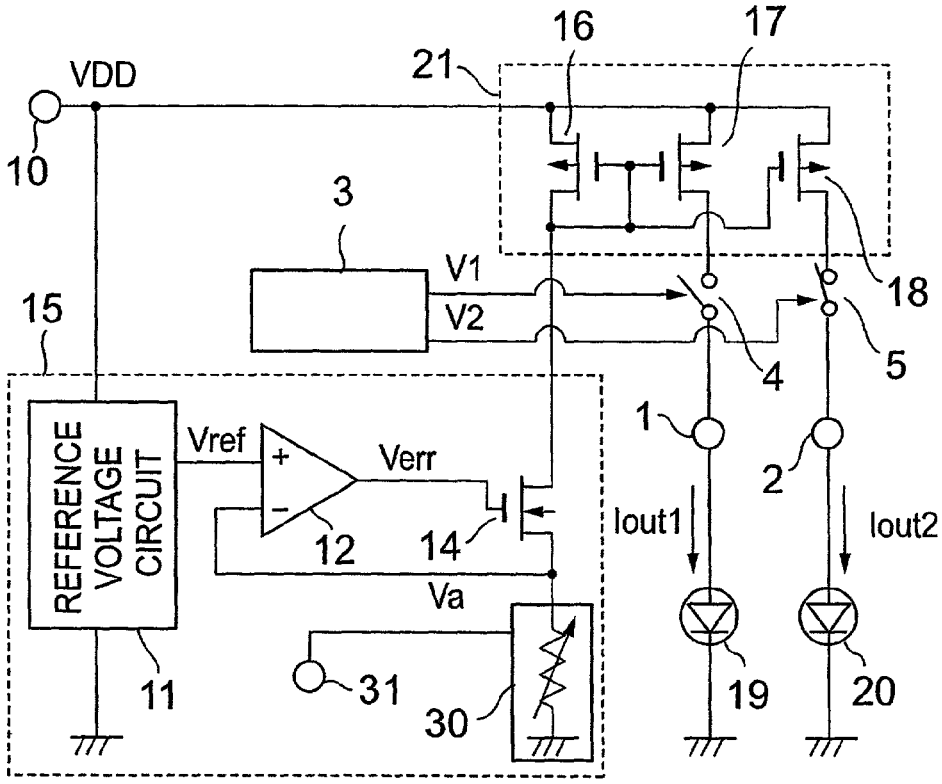
FIG. 10 is a diagram showing an LED drive circuit which represents Embodiment 4 of the present invention.

FIG. 10 shows an LED drive circuit which represents Embodiment 4 of the present invention. The circuit shown in FIG. 10 differs from that shown in FIG. 1 in that a variable resistor 30 is used in place of the resistor 13 in the constant current generation circuit 31. The variable resistor 30 changes according to a signal voltage from an external terminal 31. It is apparent from the equation (1) that each of the currents flowing through the LEDs 19 and 20 can be changed by changing the value of the variable resistor 30.

While in the arrangement shown in FIG. 10 the value of the variable resistor 30 is changed by an external signal, it is apparent from the equation (1) that each of the currents flowing through the LEDs 19 and 20 can also be changed by changing the value of output voltage Vref [V] of the reference voltage circuit 11.

The circuit shown in FIG. 10 may be modified in such a manner that the value of the variable resistor 30 is controlled not through a signal from the external terminal 31 but through an output from a temperature sensor which is provided in an integration manner in the LED drive circuit, thereby enabling the current caused to flow through each LED to be adjusted according to a characteristic of a liquid crystal which varies with temperature.

While the embodiments in which the number of LEDs to be controlled is two have been described, it is apparent that the same or more complicated LED drive method may be used to control three LEDs or more. Also, the switches 4 and 5 may be replaced with transistors which can easily used as a switch.

(Embodiment 5)

Figure 11:
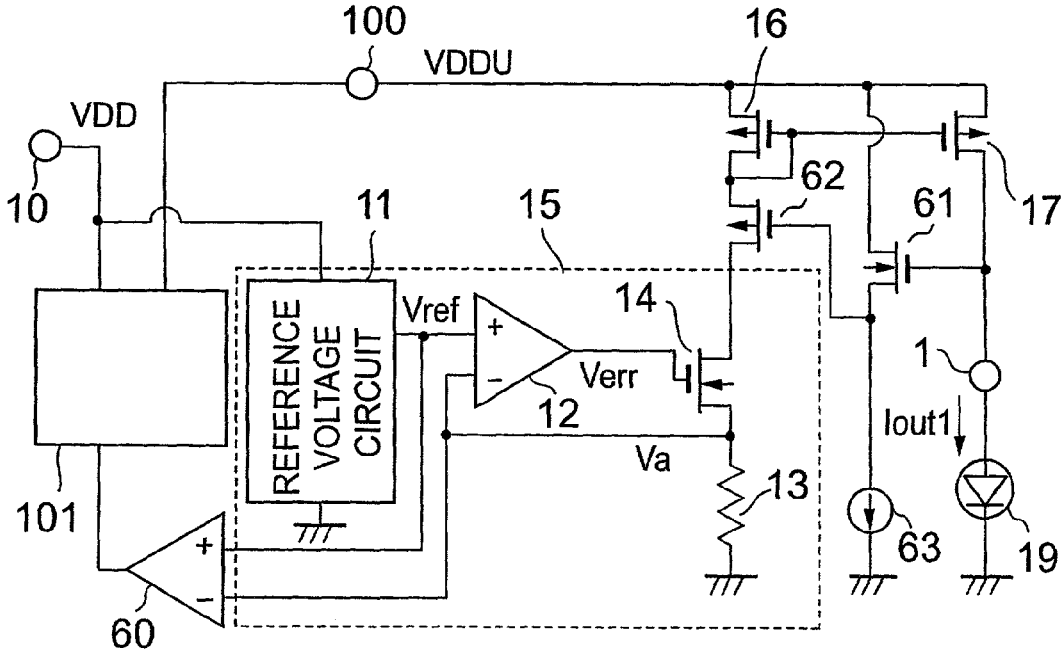
FIG. 11 is a diagram showing an LED drive circuit which represents Embodiment 5 of the present invention.

FIG. 11 shows an LED drive circuit which represents Embodiment 5 of the present invention. The same constant current generation circuit 15 as that in the conventional arrangement is used. The reference voltage circuit 11 in the constant current generation circuit 15 is supplied with power through the power supply terminal 10 connected thereto. A boosting circuit 101 boosts the voltage Vdd [V] applied to the power supply terminal 10 to a higher voltage VDDU [V] obtained through a terminal 100. The boosting circuit 101 may be realize as any type of circuit, e.g., a charge pump type using a capacitance or a switching regulator type using a coil if it can perform a boosting function. An output of a comparator 60 is connected to the boosting circuit 101. ON/OFF control of the operation of the boosting circuit 101 is performed on the basis of the output voltage of the comparator 60. The plus terminal input voltage Vref [V] of the error amplifier circuit 12 in the constant current generation circuit 15 is applied to the plus terminal of the comparator 60, while the minus terminal input voltage Va [V] of the error amplifier circuit 12 is applied to the minus terminal of the comparator 60.

Referring to FIG. 11, the boosting circuit 101 performs boosting when the output voltage of the comparator 60 is high, i.e., when Vref [V]>Va [V], and stops boosting when the output voltage of the comparator 60 is low, i.e., when Vref [V]<Va [V]. This control enables the LEDs to be driven at the optimum boosted voltage VDDU [V] at which the current flowing through the resistor 13 is I=Vref/R13 [A].

A transistor 61 in a source follower circuit is driven by a constant current source 63 to generate at its source a voltage which is lower approximately by the threshold voltage than the voltage on the terminal 1 to which the LED 19 is connected. A transistor 62 also in a source follower circuit generates at its source, i.e., the gate and drain of the transistor 16, a voltage which is higher approximately by the threshold voltage than the source voltage of the transistor 61. If the absolute values of the threshold voltage of the transistors 61 and 62 are equal to each other, a voltage approximately equal to the voltage on the terminal 1 is generated at the gate and drain of the transistor 16 and, therefore, the current mirror circuit formed by the transistors 16 and 17 can operate accurately.

For example, a lithium-ion secondary battery may be used to obtain the power supply voltage VDD [V] at the terminal 10. Its voltage is about 3.6 V. On the other hand, the forward ON voltage of a white LED is about 4.0 V at the maximum. It is necessary to boost the voltage of the lithium-ion secondary battery to the voltage at which the white LED can be lighted.

Generally speaking, if a constant current circuit is added after a stage for boosting by a boosting circuit, control is performed so that the voltage boosted by the boosting circuit has a certain constant value, e.g., 5 V. Therefore an excessively high voltage is applied between the drain and the source of the transistor 17 to cause loss or heat generation. If the boosted voltage is controlled so as to constantly maintain the LED current as in Embodiment 5, the drain-source voltage of the transistor 17 can be limited to a lower value to improve the characteristics in terms of loss and heat generation.

Figure 12:
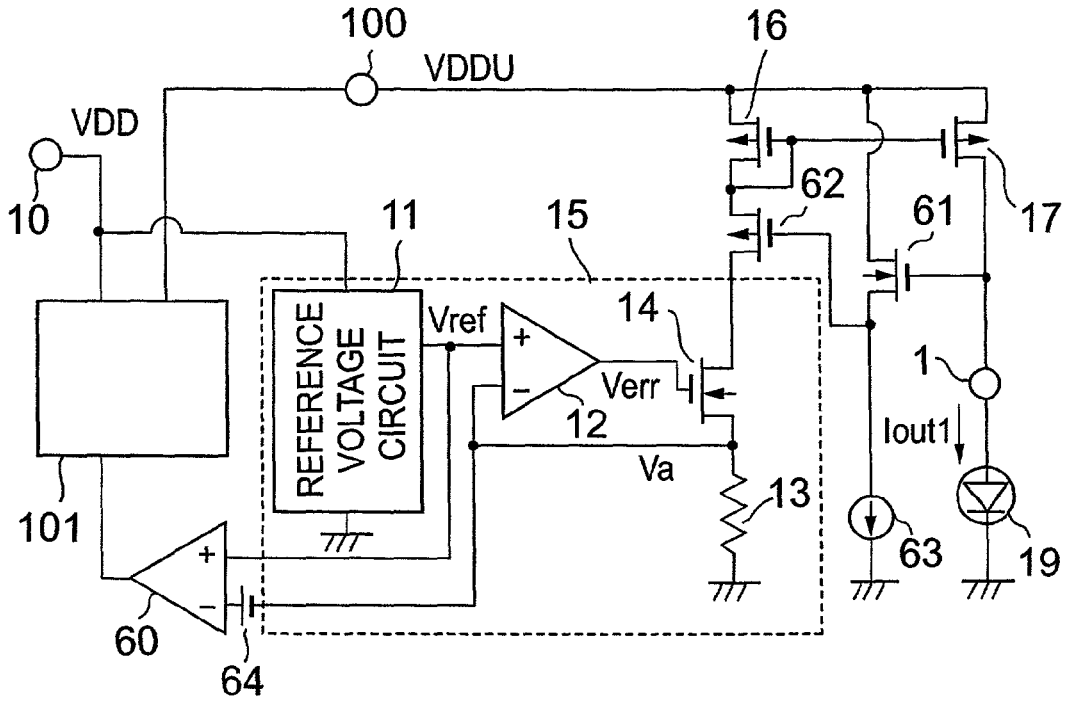
FIG. 12 is a diagram showing another LED drive circuit in Embodiment 5 of the present invention.

The arrangement shown in FIG. 12 differs from that shown in FIG. 11 in that an offsetting power supply 64 is inserted in the line to the minus input terminal of the comparator 60. In the circuit shown in FIG. 11, there is a possibility of failure to normally perform the operation, depending on the offset voltage of the comparator 60. The offsetting power supply 64 is inserted as shown in FIG. 12 to stabilize the operation. If the voltage value of the offsetting power supply is Vof1 [V], ON/OFF control of the boosting circuit 101 is such that when Vref >VA +Vof1, the output of the comparator 60 is increased and the circuit 101 performs boosting and, when Vref<VA+Vof1, the output of the comparator 60 is reduced and the circuit 101 stops boosting. The current flowing through the resistor 13 is thereby controlled so that I=(Vref−Vof1)/R13 [A].

In this case, Vof1 [V] is set to a value higher than the offset voltage of the comparator 60.

Figure 13:
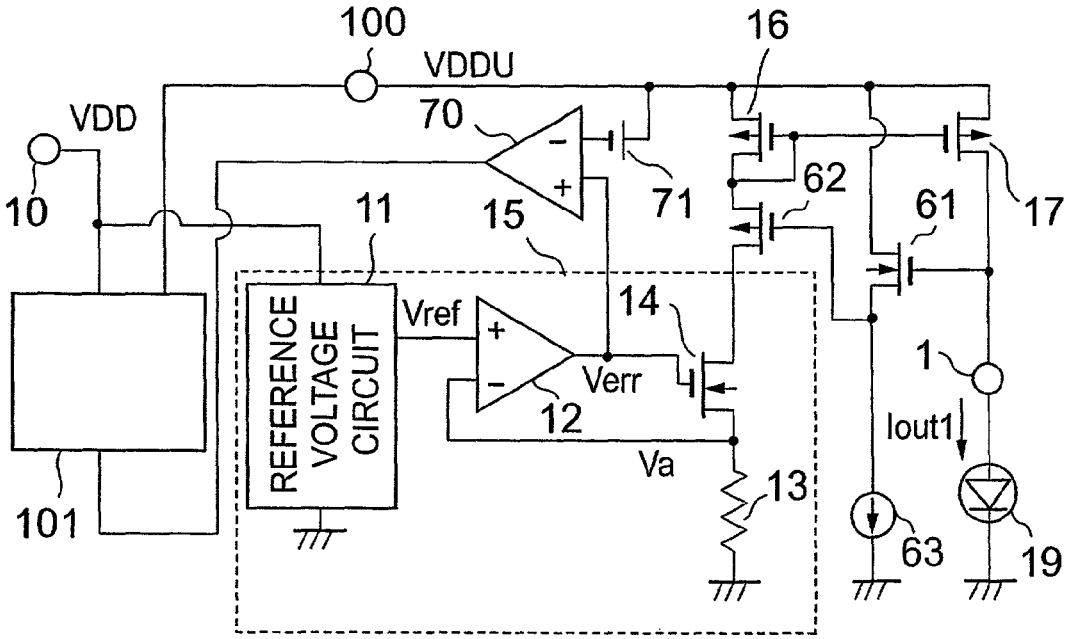
FIG. 13 is a diagram showing another LED drive circuit in Embodiment 5 of the present invention.

FIG. 13 shows another arrangement which differs from that shown in FIG. 11 in that a comparator 70 which performs ON/OFF control of the boosting circuit 101 is supplied at its plus terminal with the output voltage Verr [V] from the error amplifier 12 and at its minus terminal with a voltage obtained by subtracting a voltage Vof2 [V] of an offsetting power supply 71 from the boosted voltage VDDU [V]. In this case, ON/OFF control of the boosting circuit 101 is such that when Verr>VDDU−Vof2, the output of the comparator 70 is increased and the circuit 101 performs boosting and, when Verr <VDDU−Vof2, the output of the comparator 70 is reduced and the circuit 101 stops boosting. When the current I flowing through the resistor R13 is smaller than Vref/R13, the output Verr of the error amplifier 12 is increased. Conversely, when the current I flowing through the resistor R13 is larger than Vref/R13, the output Verr of the error amplifier 12 is reduced. Accordingly, when the current I flowing through the resistor R13 is smaller than Vref/R13, the output Verr of the error amplifier 12 is increased to the same level as VDDU. In this time, the output of the comparator 70 is high and the boosting circuit 101 performs boosting. Thereafter, when the value of the voltage VDDU is increased to the level high enough to enable the constant current circuit 15 to cause a current to flow, the output voltage Verr of the error amplifier 12 decreases gradually. When Verr<VDDU−Vof2, the output of the comparator 70 is reduced to stop the boosting operation of the boosting circuit 101. This control enable prevention of an excessive increase in boosted voltage VDDU, thereby improving the characteristics in terms of loss and heat generation, as described above.

The comparator 60 shown in FIG. 11 or 12 and the comparator 70 shown in FIG. 13 may be arranged to have a certain amount of hysteresis to improve the stability of the circuit.

(Embodiment 6)

Figure 14:
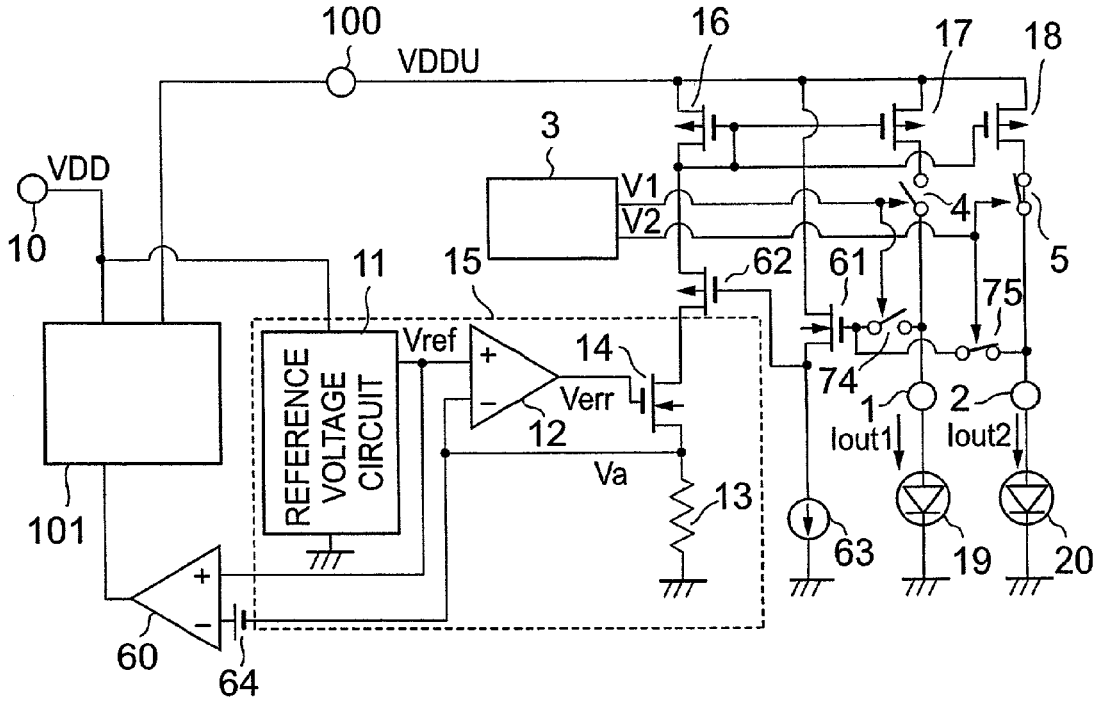
FIG. 14 is a diagram showing an LED drive circuit which represents Embodiment 6 of the present invention.
Figure 15:
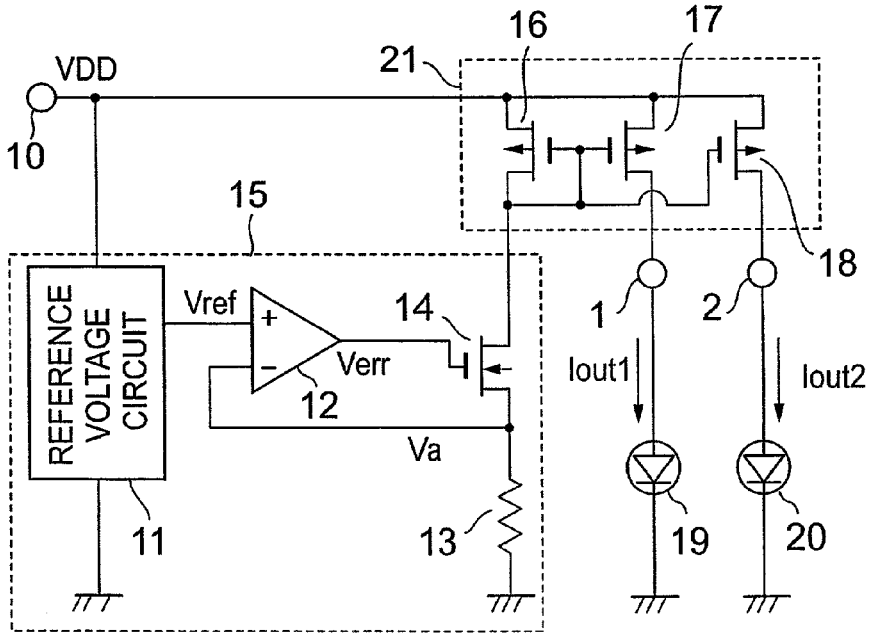
FIG.15 PRIOR ART
FIG. 15 is a diagram showing a conventional LED drive circuit.

FIG. 14 shows Embodiment 6 of the present invention. The circuit shown in FIG. 14 is formed, compared to that shown in FIG. 12, by adding a switching control circuit 3, switches 4 and 5, and an LED 20. All of these components are equivalent to those shown in FIG. 1. Switches 74 and 75 are further added. The switches 4 and 74 operate in synchronization with each other and the switches 5 and 75 also operate in synchronization with each other. When the switch 4 is closed, the switch 74 is also closed. When the switch 4 is opened, the switch 74 is also opened. The switches 5 and 75 are also in the same relationship.

Since blinking-of the LEDs 19 and 20 is controlled by the switch control circuit 3, ON/OFF control of the boosting circuit 101 is performed by using the anode voltage of the lighted LED.

However, the switches 74 and 75 are controlled on such a logic that one of them is operated with priority over the other and they are thereby prevented from being turned on simultaneously with each other when both the LEDs 19 and 20 are ON.

The arrangement may be such that, to eliminate occurrence of instability of operation when both the LEDs 19 and 20 are OFF, an OR output is obtained from the outputs V1 and V2 from the switch control circuit 3 and the boosting operation of the boosting circuit 101 is stopped when this output is low (L).

Further, lighting of the LEDs 19 and 20 may be controlled so that they are lighted in a complementary relationship with each other to optimize the LED drive circuit including the boosting circuit, because the boosting ability of the boosting circuit 101 may be reduced by half in comparison with that required in the case of continuous lighting.

It is not always necessary to light the LEDs 19 and 20 in a complementary relationship. Various drive methods, including those in Embodiments 1 to 4, are conceivable and any number of LEDs equal to or greater than 2 may be used.

The LED drive circuit of the present invention has the advantage of reducing power consumption during drive of LEDs by lighting the LEDs in a way most suitable for characteristics of a liquid crystal.

What is claimed is:

1. A light emitting diode (LED) drive circuit comprising: a boosting circuit for boosting a power source voltage and outputting a boosted voltage; a constant current circuit for producing a constant current; a driver circuit for driving at least one LED with the boosted voltage and the constant current; and a control circuit for controlling the boosting circuit to boost the power source voltage when the constant current is smaller than a predetermined value, and to not boost the power source voltage when the constant current has the predetermined value or more.

2. A light emitting diode (LED) drive circuit according to claim 1; wherein the control circuit causes each of the LEDs to periodically turn on and off at a rate higher than a visual perception rate.

3. A light emitting diode (LED) drive circuit according to claim 1; wherein the control circuit causes each LED to turn on at a different time from the other LEDs.

4. A light emitting diode (LED) drive circuit comprising: boosting means for boosting a power source voltage and outputting a boosted voltage; constant current means for producing a constant current; driving means for driving at least two LEDs by a the constant current and the boosted a voltage; at least two switches connected to respective ones of the at least two LEDs; a switch control circuit for controlling the switches; and means for boosting the power source voltage when the constant current is smaller than a predetermined value, and for not boosting the power source voltage when the constant current has the predetermined value or more, such that at least one of the LEDs is periodically turned on and off at certain time intervals in a time-division manner based on operation of the switch control circuit.

5. A light emitting diode (LED) drive circuit according to claim 4; wherein the certain time intervals are higher than a visual perception rate.

6. A light emitting diode (LED) drive circuit according to claim 4; wherein each LED is turned on at a different time from the other LEDs.

* * * * *